US011187389B2

(12) United States Patent
Leonardo et al.

(10) Patent No.: US 11,187,389 B2
(45) Date of Patent: Nov. 30, 2021

(54) LED TRACK ELEMENT FOR TRACK LIGHTING SYSTEMS

(71) Applicant: Lighting Services, Inc., Stony Point, NY (US)

(72) Inventors: Brian Leonardo, Montclair, NJ (US); David Michael Cowan, Cornwall Bridge, CT (US); Joshua Lars Peterson, Brooklyn, NY (US)

(73) Assignee: Lighting Services, Inc., Stony Point, NY (US)

( * ) Notice: Subject to any disclaimer, the term of this patent is extended or adjusted under 35 U.S.C. 154(b) by 0 days.

(21) Appl. No.: 16/939,830

(22) Filed: Jul. 27, 2020

(65) Prior Publication Data

US 2021/0025557 A1 Jan. 28, 2021

Related U.S. Application Data

(60) Provisional application No. 62/878,550, filed on Jul. 25, 2019.

(51) Int. Cl.

| | |
|---|---|
| ***F21S 8/06*** | (2006.01) |
| ***F21V 21/35*** | (2006.01) |
| ***H01R 25/14*** | (2006.01) |
| ***F21S 8/00*** | (2006.01) |

(52) U.S. Cl.

CPC ..... *F21S 8/068* (2013.01); *F21S 8/038* (2013.01); *F21V 21/35* (2013.01); *H01R 25/142* (2013.01)

(58) Field of Classification Search

CPC ..... F21V 21/005; F21V 21/35; F21S 8/038; F21S 8/066; H01R 25/14–147

See application file for complete search history.

(56) References Cited

U.S. PATENT DOCUMENTS

2009/0284988 A1* 11/2009 Snagel ..... F21V 29/70 362/648
2012/0092875 A1* 4/2012 Cho ..... F21S 2/005 362/311.01

FOREIGN PATENT DOCUMENTS

KR 100970509 B1 * 7/2010
WO WO-2012109683 A1 * 8/2012 ..... F21V 23/06
WO WO-2013120892 A2 * 8/2013 ..... F21V 7/0083

* cited by examiner

*Primary Examiner* — Mariceli Santiago
(74) *Attorney, Agent, or Firm* — St. Onge Steward Johnston & Reens LLC

(57) ABSTRACT

An LED luminaire for a track lighting system, that takes the form of a track section rather than a more customary separate device attached to a track section. The new luminaire has an elongated, extruded housing configured to correspond to the exterior of standard track sections to visually blend in with the overall track system. A circuit board, mounting a plurality of longitudinally aligned LED elements, extends for the full length of the housing, providing downward illumination through an optic member closing the bottom of the housing. The LED housing has a plug-in type connection to an adjacent track section providing physical alignment, electrical power and data functions. Successive luminaires can be connected together, and the new luminaires can be connected to additional standard track sections. The new luminaires can be installed throughout an overall track lighting system, substantially without limitation as to number and/or order.

16 Claims, 10 Drawing Sheets

LED TRACK ELEMENT FOR TRACK LIGHTING SYSTEMS

FIELD OF THE INVENTION

The invention relates to a novel form of LED luminaire that can be inserted into and form a working part of a standard track lighting system. The new fixture has a form and appearance consistent with regular track sections of the system and serves, in addition to its illumination functions, as an integral part of the system, transferring power and (if needed) data functions for portions of the system downstream of the luminaire.

BACKGROUND OF THE INVENTION

Track lighting systems are well known and widely used. Typical track systems involve the use of linear track sections that can be mechanically and electrically joined in various track configurations to serve an area requiring illumination. In typical track systems, the track sections, which may be linear extrusions of aluminum, are connected with other such extrusions by joiner elements. The joiner elements may be linear, for end to end connection of track elements, or angular for connecting track elements at an angle. Angular joiners may have a plurality of connections for joining multiple linear track elements in an angular array, such as three or four elements oriented at right angles In a typical track system the track sections accommodate the attachment of lighting fixtures and other electrical devices, such as power outlets, at any point along the linear track. A common such fixture or device is provided with a rotary element, including mounting elements and electrical contacts. To install the fixture or device, the rotary element is aligned with a downwardly opening, recessed slot running the length of the track, allowing the rotary element to be inserted into the recessed slot at any point along its length. After insertion, the rotary element is rotated 90 degrees such that the mounting elements engage retaining flanges in the recessed slot and the electrical contacts are engaged with conductors housed within the track. The electrical conductors carried by the track sections include power conductors (e.g., 120 v, 20 amp conductors), and often include a plurality of additional data conductors for control purposes. All of such conductors typically are bare copper wires carried by an insulating liner or liners positioned internally of the aluminum track and accessible for contact by elements of the fixture or device being installed.

SUMMARY OF THE INVENTION

The present invention is directed to a novel and advantageous form of a linear LED lighting fixture or luminaire which in itself is in the form of a track section and can be inserted into a standard track lighting system, not as a typical attachment with rotary contacts and mounting elements, but by installation into the track system as one of the functioning track elements thereof. The new LED luminaire, is incorporated into a track extrusion corresponding generally in shape and appearance to the standard track sections and can be installed in a track system substantially as one of the ordinary track sections. An LED luminaire according to the invention may comprise a series of LED elements mounted on an elongated printed circuit board, in an arrangement extending over substantially the entire length of the track section in which it is mounted to provide an elongated, linear LED light source. In one preferred embodiment of the invention, primary power (e.g., 120 volts, 20 amps), is transferred through the luminaire by mean of an electrical harness. The circuit board is also provided with a plurality of copper traces forming a data bus for control functions. In another preferred embodiment, additional copper traces on the circuit board are of heavier weight and serve to carry the primary, 20 amp power load. The LED luminaire of the invention thus also serves the function of a standard track section in an overall system and can be inserted anywhere in the system as one of the track sections thereof.

In one preferred embodiment of the invention, the luminaire housing 1s an extrusion comprising a pair of vertical side walls spaced apart and connected by a horizontal web in an upper portion of the housing. A circuit board, with a plurality of LED elements spaced longitudinally along its length, is mounted on the underside of the horizontal web. A spine member, which is separate from the luminaire housing, is recessed in the upper portion of the housing. The spine member defines downwardly opening wireways at each side, one of which contains an AC power harness and the other of which can optionally be used for other purposes. The spine member is intended to be secured to a ceiling, in alignment with an adjacent track section and/or another luminaire, and the luminaire housing is mounted in position by attachment to the spine member. The bottom of the luminaire housing is closed by an advantageous form of snap-in optic element. The optic element is provided with internal walls extending upward and inward from each side toward the LED elements and has reflective surfaces to redirect lateral light in a downward direction. Short side flanges extend upward from the bottom wall of the optic to provide for quick, snap-in assembly of the optic onto the extrusion.

In a preferred embodiment of the invention, the joiners, for connecting luminaires to standard track sections, include means for blocking the passage of stray light from the luminaires into standard track sections by way of the various longitudinally disposed conductor-receiving channels in the track sections.

For a more complete understanding to the invention reference can be made to the following detailed description of preferred embodiments of the invention and to the accompanying drawings.

BRIEF DESCRIPTION OF THE DRAWINGS

FIG. 20 is an orthographic view from below of a modified form of LED luminaire according to the invention.

DETAILED DESCRIPTION OF THE INVENTION

Figure 1:
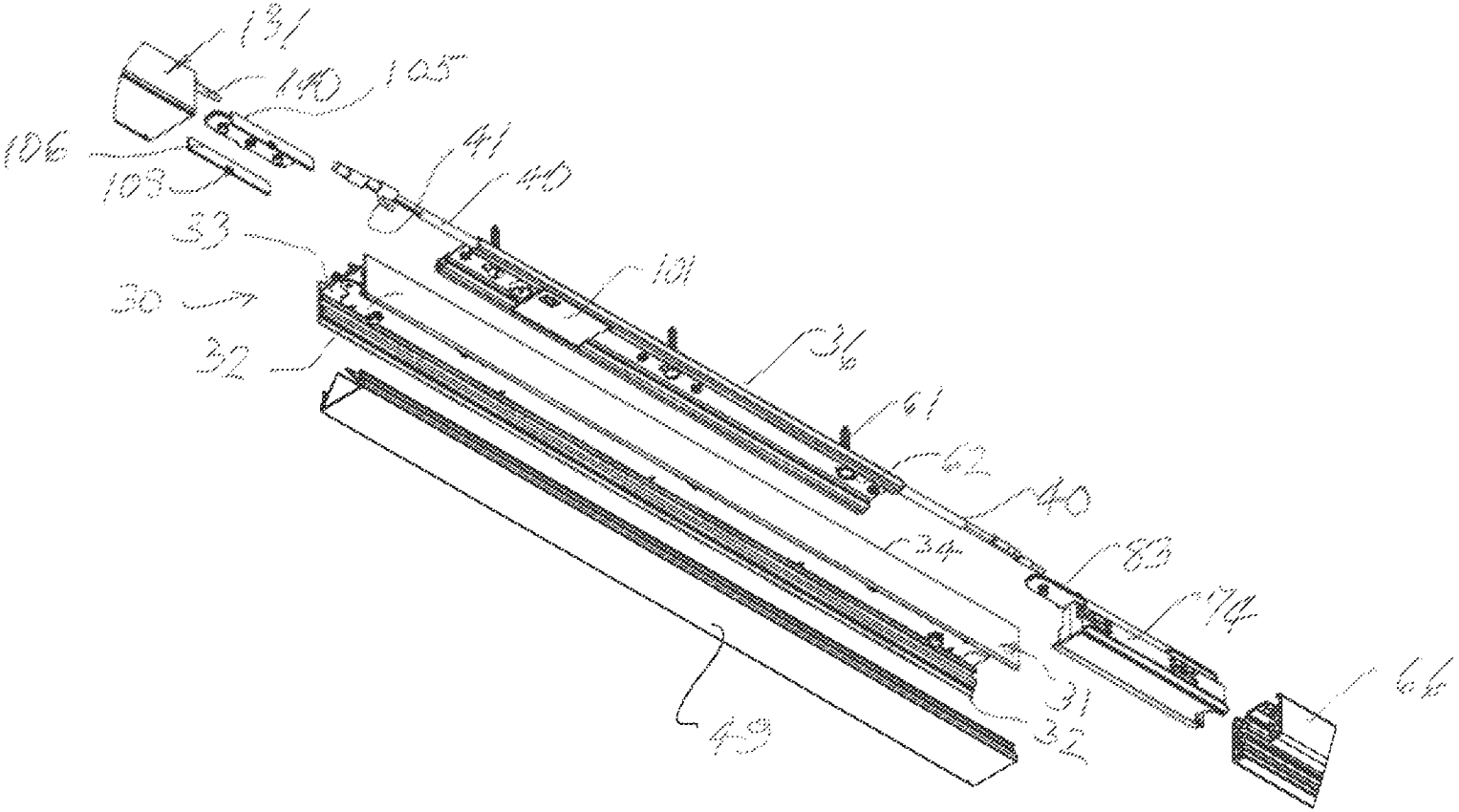
FIG. 1 is an exploded view of an LED luminaire according to the invention along with indications of the manner of its connection to standard track sections and other LED luminaires.

Referring to the drawings, the reference numeral 30 designates generally an LED luminaire according to the invention. The main body 31 of the luminaire is an extrusion, typically of aluminum, configured to form opposite side walls 32 joined in spaced apart relation by a horizontal web 33. The web 33 is positioned a short distance below the upper edges 34, 35 of the side walls 32 to define an upwardly opening channel for the reception of a spine member 36, the various functions of which are described below. The extruded body 31 typically may have a length of 24 inches but of course can be made of various lengths consistent with available lengths of standard track sections.

Figure 4:
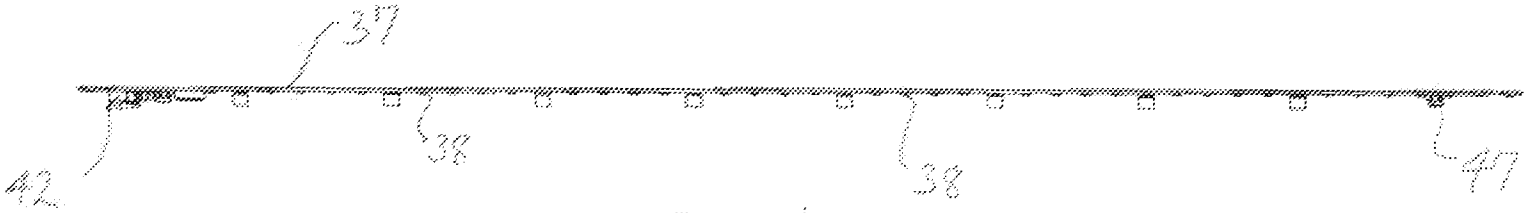
FIG. 4 is a front elevational view of the pc board of FIG. 3.
Figure 3:
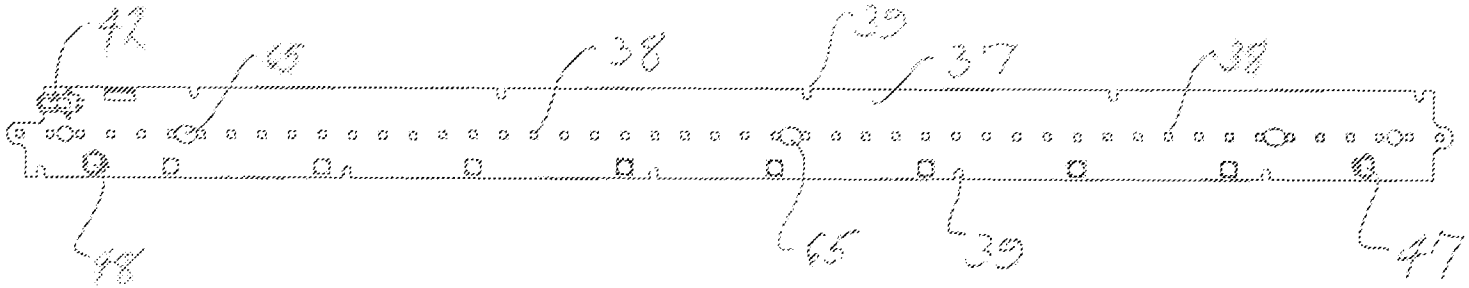
FIG. 3 is a bottom plan view of a printed circuit board incorporated in the LED luminaire of FIGS. 1 and 2 and mounting a plurality of longitudinally spaced LED elements.

Pursuant to an aspect of the invention, a printed circuit board 37 (FIGS. 3 and 4) is attached to the underside of the web 33. Desirably, the pc board 37 extends for substantially the full length of the extruded body 31 and mounts a plurality of LED elements 38 along a longitudinally extending center line of the board. Desirably, the LED elements can be spaced about one-half inch apart to provide 48 elements on a pc board of approximately 24 inches in length. In the illustrated embodiment, the pc board 37 is tightly secured to the horizontal web by means of a plurality of screws (not illustrated), which are received in notches 39 spaced along the opposite side edges of the pc board and engage openings (not illustrated) in the web 33. The pc board 37, which preferably is made of aluminum is thus in tight contact with the horizontal web 33 providing for good heat conductivity away from the LED elements 38. Preferentially, the pc board 37, with respect to its LED circuitry, may be a High Voltage AC-LED Module as made available commercially by Lynk Labs of Elgin, Ill. under its registered trademark "SnapBrite". The relevant LED circuitry, which does not form part of this invention, is positioned on the upper surface of the pc board.

AC Power to the LED elements 38 is supplied by a pass-through harness 40 (FIG. 1) which is connected to the primary track system by arrangements to be described. A pig tail 41 leads from the harness, through an opening or recess at the end of the horizontal web 33, and has a plug-in connection with a socket 42 mounted at one end of the pc board 37. The socket 42 is suitably connected to printed circuit elements on the board 37 to supply power to the LED elements. The pass through harness is received in a partially confined channel 43 (FIGS. 18, 19) at one side of the spine member 36 and is held in place by a snap-in retainer strip 44, preferably formed of insulating material. The illustrated spine member 36 has a similar conductor-receiving channel 45 at the opposite side thereof, also provided with a snap-in retainer 46, for optionally housing other conductors, where desired.

Where dimming and other LED control features are to be provided to the PC board 37, separate longitudinally extending conductors (not shown) forming a data bus are provided. To advantage, the pc board 37 is provided with plug-in receptacles 47, 48 at opposite ends of the data bus, one adapted to receive a data input plug and the other adapted to receive a data output plug. Connections between the two plug-in receptacles 47, 48 are by means of printed conductors (typically three) on a surface of the pc board. Thus, data voltages are supplied to the board 37 via a plug connector (not shown) and to the LED elements via circuitry on the board. The data voltages are also supplied to the next downstream element of the system, which may be another LED luminaire or a standard track section, via a plug connector (not shown) connected to the plug-in receptacle 48 at the downstream end of the pc board 37.

Figure 5:
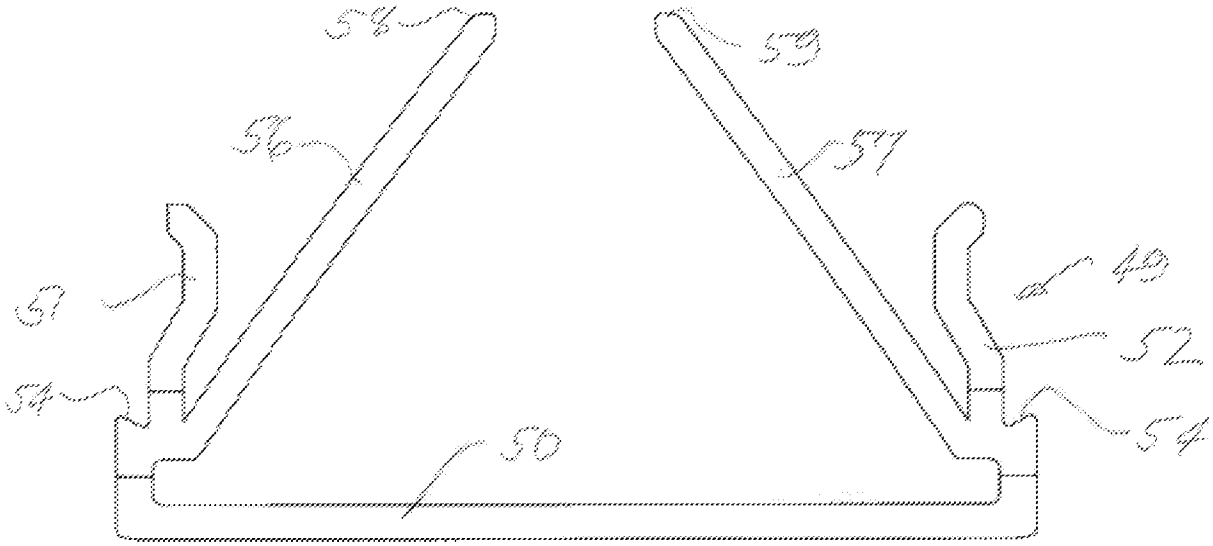
FIG. 5 is an end elevational view of an optic element which forms the bottom of the new LED luminaire.
Figure 6:
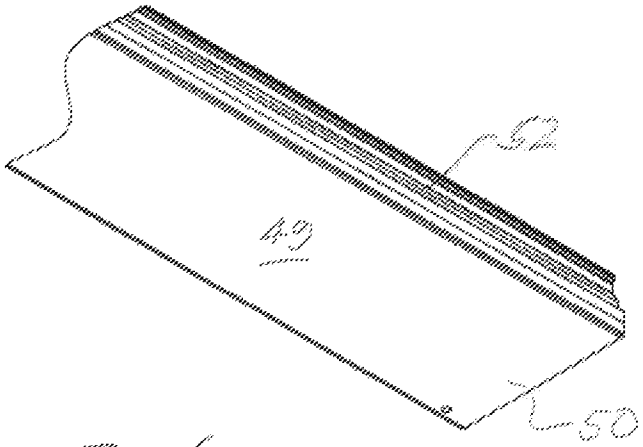
FIG. 6 is a fragmentary orthographic view from below of the optic element of FIG. 5.
Figure 18:
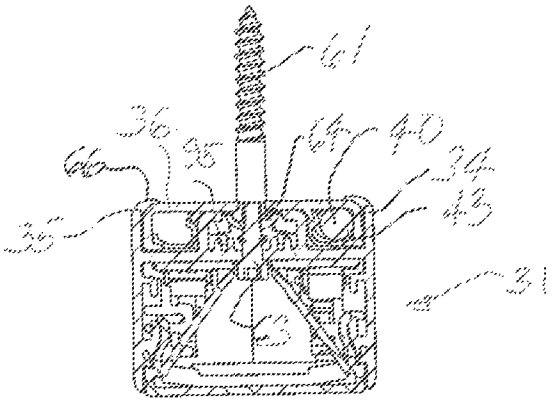
FIGS. 18 and 19 are cross sectional views as taken generally on lines 18-18 and 19-19, respectively, of FIGS. 13 and 14 respectively.
Figure 19:
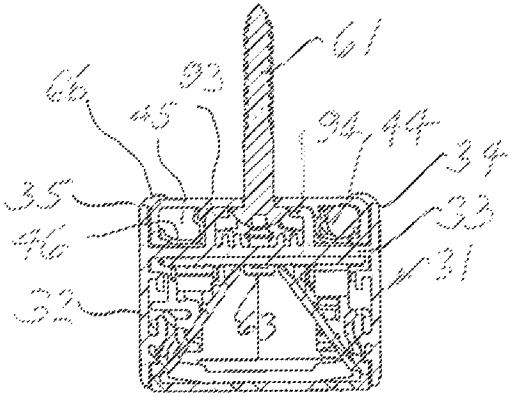

The open bottom of the luminaire body 31 advantageously is closed by an optic element 49, shown best in FIG. 5. The optic element, which can be formed as a plastic extrusion, comprises a flat, translucent bottom wall 50 which extends across the full open width between the side walls 32 of the body 31 (FIGS. 18, 19). Gripping flanges 51, 52 project upwardly a short distance from the bottom wall 50 and are contoured for a snap-on engagement with projecting surfaces 53 (FIG. 12) on the insides of the body side walls 32. The gripping flanges 51, 52 are inset slightly to form seats 54 engageable with ribs 55 (FIG. 12) on the side walls 32 to accurately position the optic element 49 with respect to the body 31. The optic element 49 also includes reflecting walls 56, 57 which extend upward and inward from outer edges of the bottom wall and form reflective surfaces to redirect light downwardly through the bottom wall 50. Desirably, the upper ends 58, 59 of the reflecting walls extend into contact with the pc board closely adjacent to the LED elements 38. The optic element 49 is designed to fit snugly at the sides of the body 31 and to extend for the full length thereof. Accordingly, to facilitate removal of the optic, a small opening 60 may be provided in the bottom wall 50 near one end thereof for insertion of a removal tool.

The illustrated embodiment of the luminaire is attached to a ceiling by means of the spine member 36, which typically is secured by means such as screws 61 received in slotted openings 62 in the spine member. The main body 31 of the luminaire is thereafter secured to the spine member by means of screws 63 (FIG. 18) which engage threaded elements 64 positioned along the center line of the spine member 36. Enlarged openings 65 in the pc board (FIG. 3) accommodate the enlarged heads of the screws. Before the main body 31 is attached, electrical connections are made to the upstream element, which in the illustration is a standard track section 66. These connections are made by means of a joiner 74 (FIGS. 8, 9) which is received within the standard track section and is connected to the pass through harness 40.

Figure 16:
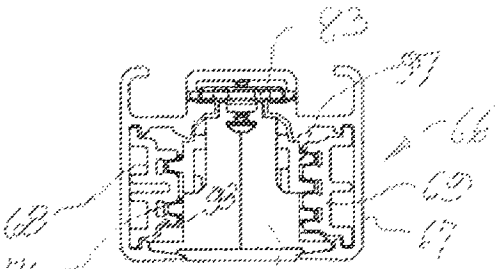
FIGS. 16 and 17 are opposite end views of a standard track section in which a joiner element of FIGS. 7-10 has been installed.

The standard track section 66 comprises an extruded section 67 which mounts insulated carriers 68, 69 (FIGS. 16, 17) at opposite sides. The insulated carrier 68 has two inwardly opening grooves 70 which receive copper conductors 71 for supplying AC power. The opposite side carrier 69 is provided with three such inwardly opening grooves 72 which receive copper conductors 73 for supplying data. An advantageous form of standard track section is that commercially available from Lighting Services, Inc., of Stony Point, N.Y., under its trademark "CONTROL TRACK".

Figure 8:
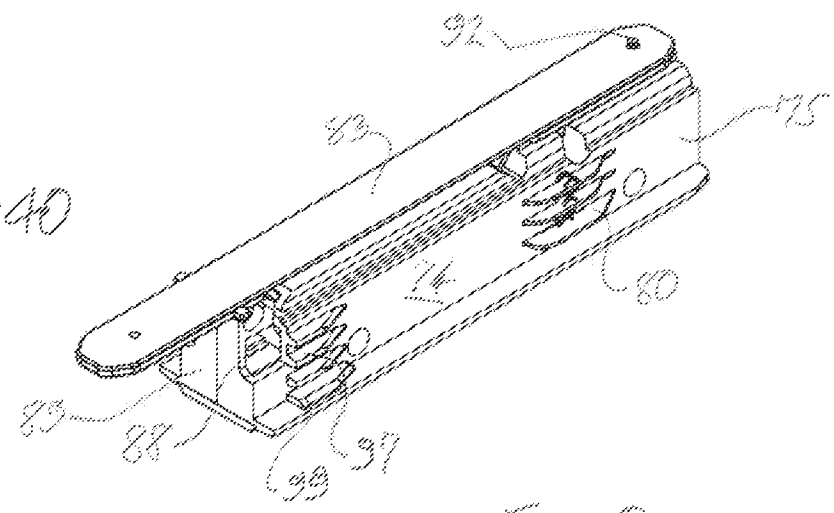
FIGS. 7 and 8 are orthographic views, from above showing opposite ends, of a joiner element for connecting the new LED luminaire, electrically and mechanically, to a standard track section.
Figure 7:
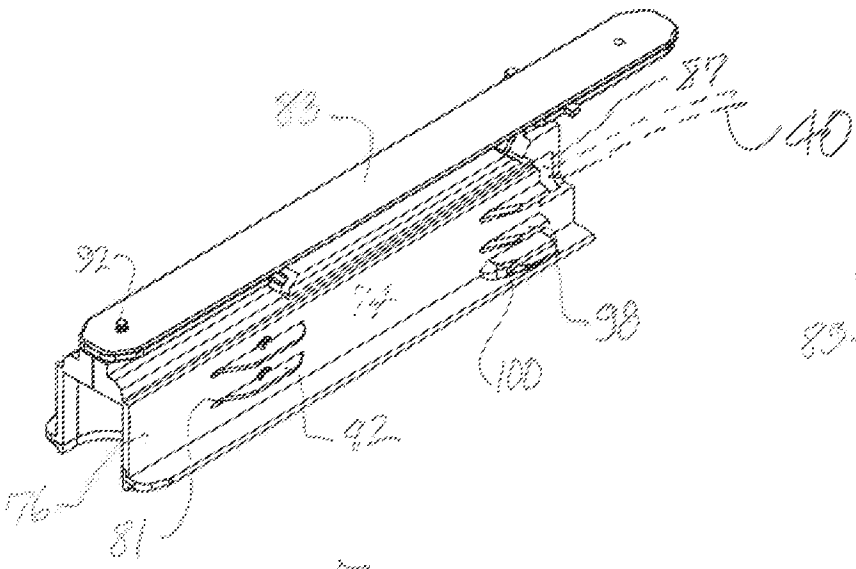
Figures 9, 10:
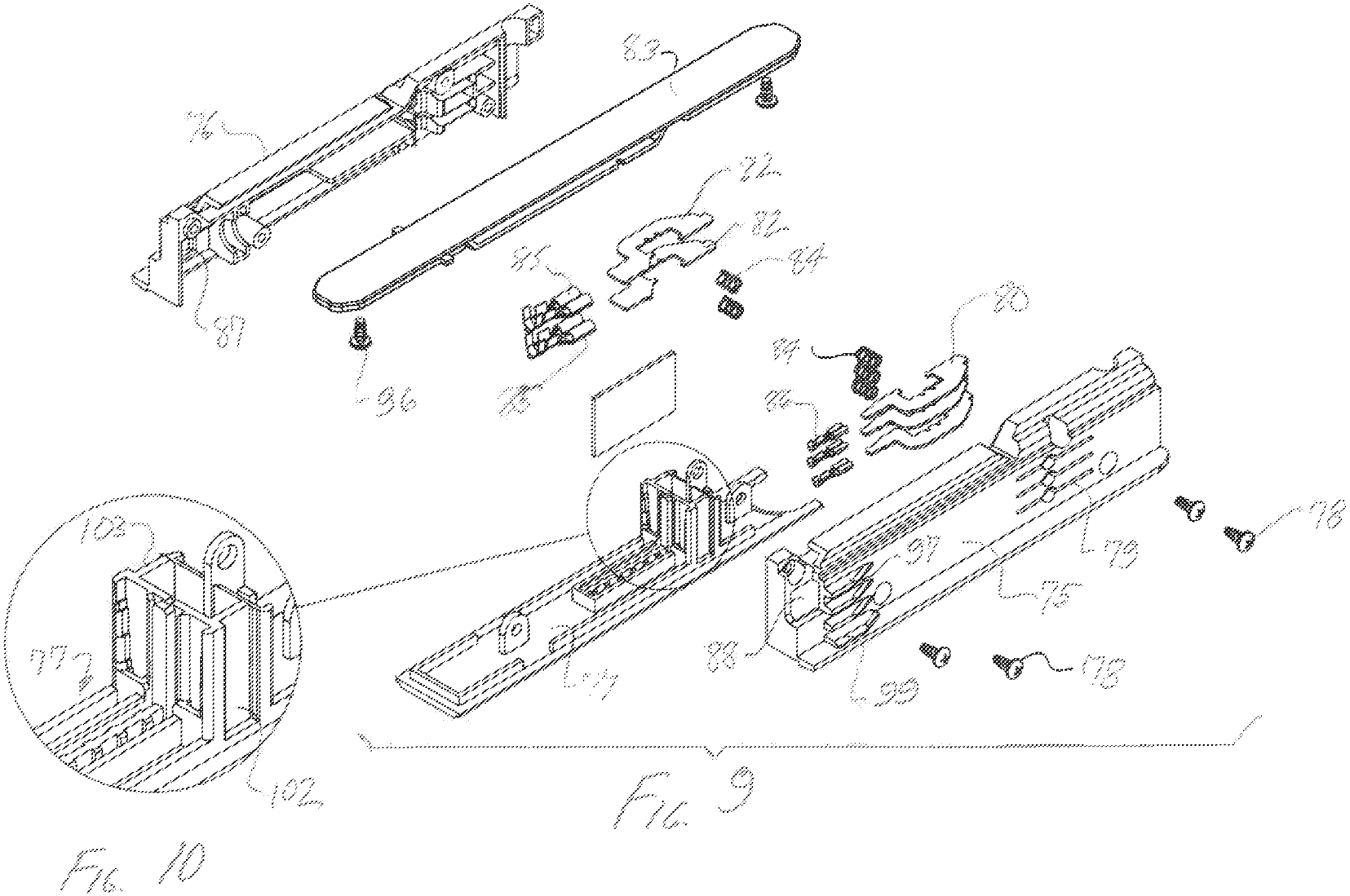
FIG. 9 is an exploded view of the joiner of FIGS. 7 and 8.
FIG. 10 is an enlarged detailed view of the encircled portion of FIG. 9.

With reference to FIGS. 7-10, the joiner 74 comprises opposite housing sides 75, 76, a housing bottom 77, and a connecting tongue 83, which can be assembled as a unitary housing and secured with screws 78. One housing side 75 is provided with three vertically spaced, horizontal slots 79 for the laterally slidable reception of data contact elements 80. The opposite housing side 76 is formed with two vertically spaced horizontal slots 81 (FIG. 7) for the laterally slidable reception of AC power contact elements 82. The contact elements 80, 82 are engaged internally of the housing by springs 84, which are seated against vertical abutment walls 102, 103 projecting upward from the housing bottom 77 (FIG. 10) and urge the contact elements to outer limit positions as shown in FIGS. 7 and 8. When the joiner is inserted into the end of a standard track section, the contact elements 80, 82, which are tapered at their leading ends, engage the conductors in their insulated carriers and are displaced inward against the springs to provide a desired electrical contact.

An AC power connection between the joiner and the luminaire is provided by means of the pass through harness 40. The two conductors of the harness 40 are affixed to spade terminals 85, which are in turn connected to the laterally slidable power contacts 82. Data connections, if utilized, are provided through a three-wire harness (not shown) extending from the joiner to the upstream plug-in receptacle 47 on the pc board 37. The conductors of the three-wire harness are connected with respective data contact elements 80 by spade terminals 86. The respective harnesses are lead out through end openings 87, 88 in the housing parts 76, 75 respectively.

Figure 17:
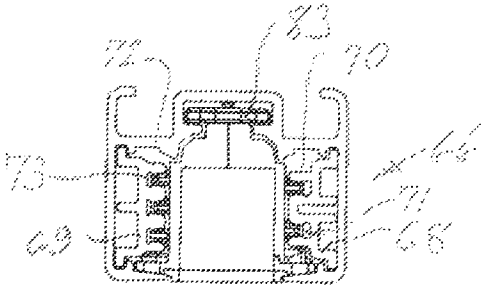
Figure 10:
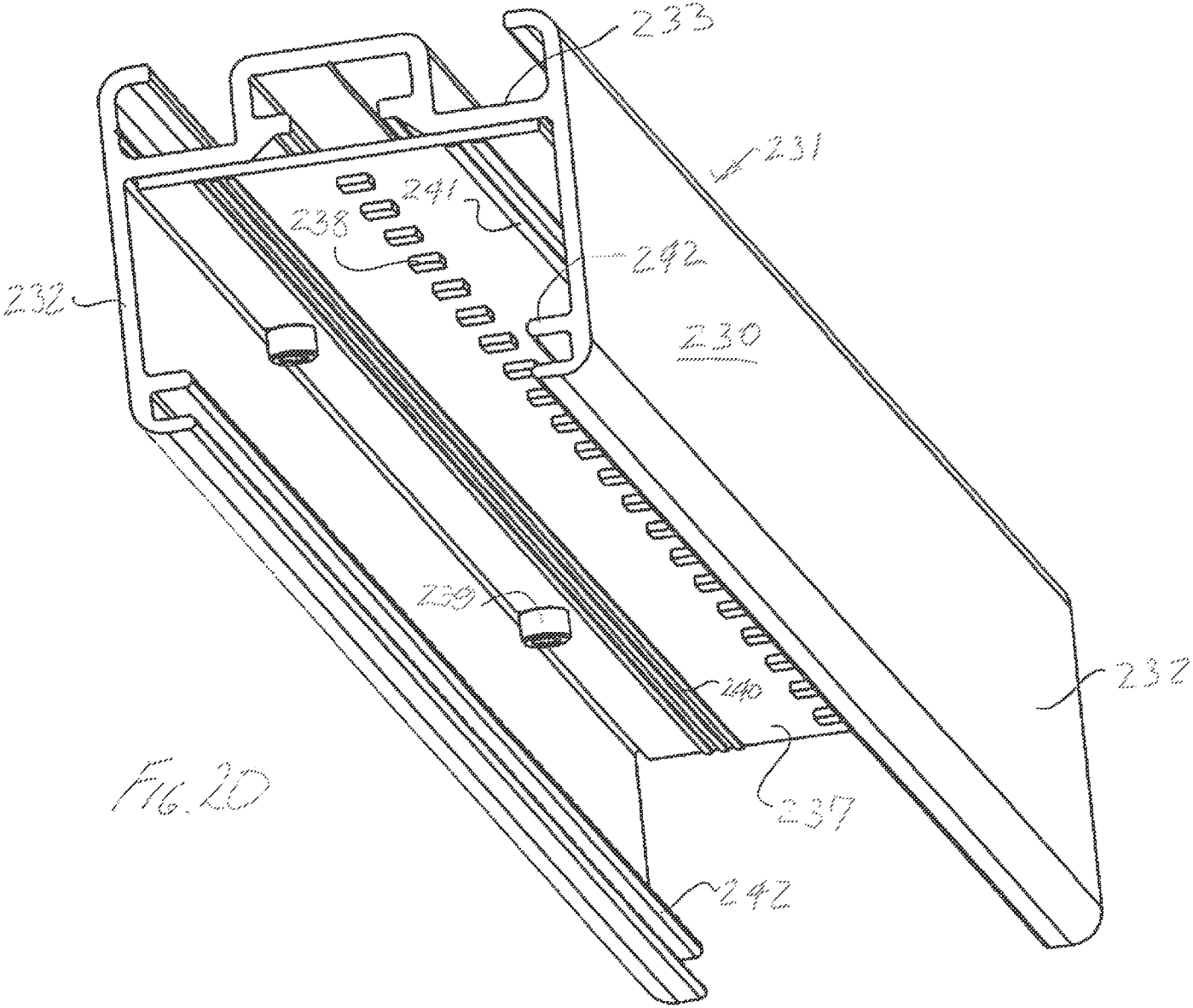

When the joiner 74 is installed in the track section 66, the outer end 89 of the joiner is substantially flush with the end of the track section, and the outer end of the connecting tongue 83 extends out from the joiner. The inner end of the connecting tongue is received within a narrow space in the track section, between a top wall 90 and flanges 91 spaced below (FIG. 17). The inner end of the connecting tongue is secured to the track section by a screw 92, which is accessible from below the inner end of the joiner. When an LED luminaire is physically joined with the track section, the outer end of the connecting tongue 83 is received in a similar narrow space in the luminaire, between upwardly extending flanges 93, 94 of inverted L-shaped configuration and ribs 95 (FIG. 18) located below. A screw 96, accessible through openings in the pc board 37, is tightened to secure the projecting end of the tongue 83 to the luminaire.

As shown in FIGS. 7 and 8, the joiner 74 is provided adjacent its forward end with short, laterally projecting, flanges 97, 98 that are aligned longitudinally with the respective data contacts 80 and power contacts 82. The flanges 97, 98 are integrally molded with the plastic housing parts 75, 75 and thus are non-conductive. When the joiner is fully inserted into a track section, the flanges 97, 98 are received in the conductor-retaining grooves in the insulated carriers 68, 69 (FIG. 16) and serve to block stray light from the adjacent luminaire from being visible in the open channel of the track section. Additional flanges 99, 100 are provided at the base of the joiner, directly below the flanges 97, 98 to block a light path at the bottom of the track section.

Figure 13:
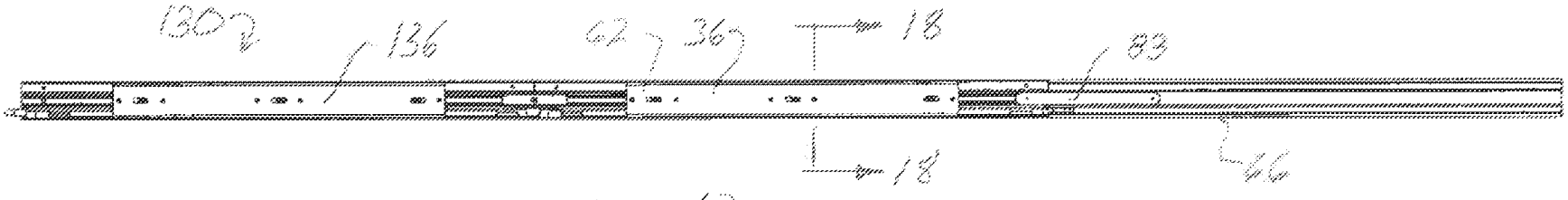
FIG. 13 is a top plan view of an assembly of two of the new LED luminaires together with a standard track section.

As can be seen in FIGS. 1 and 13, the spine member 36 is a few inches shorter than the main body 31 of the luminaire. This facilitates necessary manipulations of the harness 40, pig tail 41 and possible other wiring during installation and maintenance. Additionally, a short length of the top structure of the luminaire main body 31, including the Inverted L-shaped flanges 93, 94 and the ribs 95 (FIGS. 18, 19), preferably is cut away to provide an area for looping of extra wire length. A portion of the snap-in retainer 44 is removed adjacent the looping area to enable a looping portion to exit and re-enter the harness channel 43. A plastic cover plate 101 (FIG. 1) may be provided to close the underside of the looping area.

Figure 2:
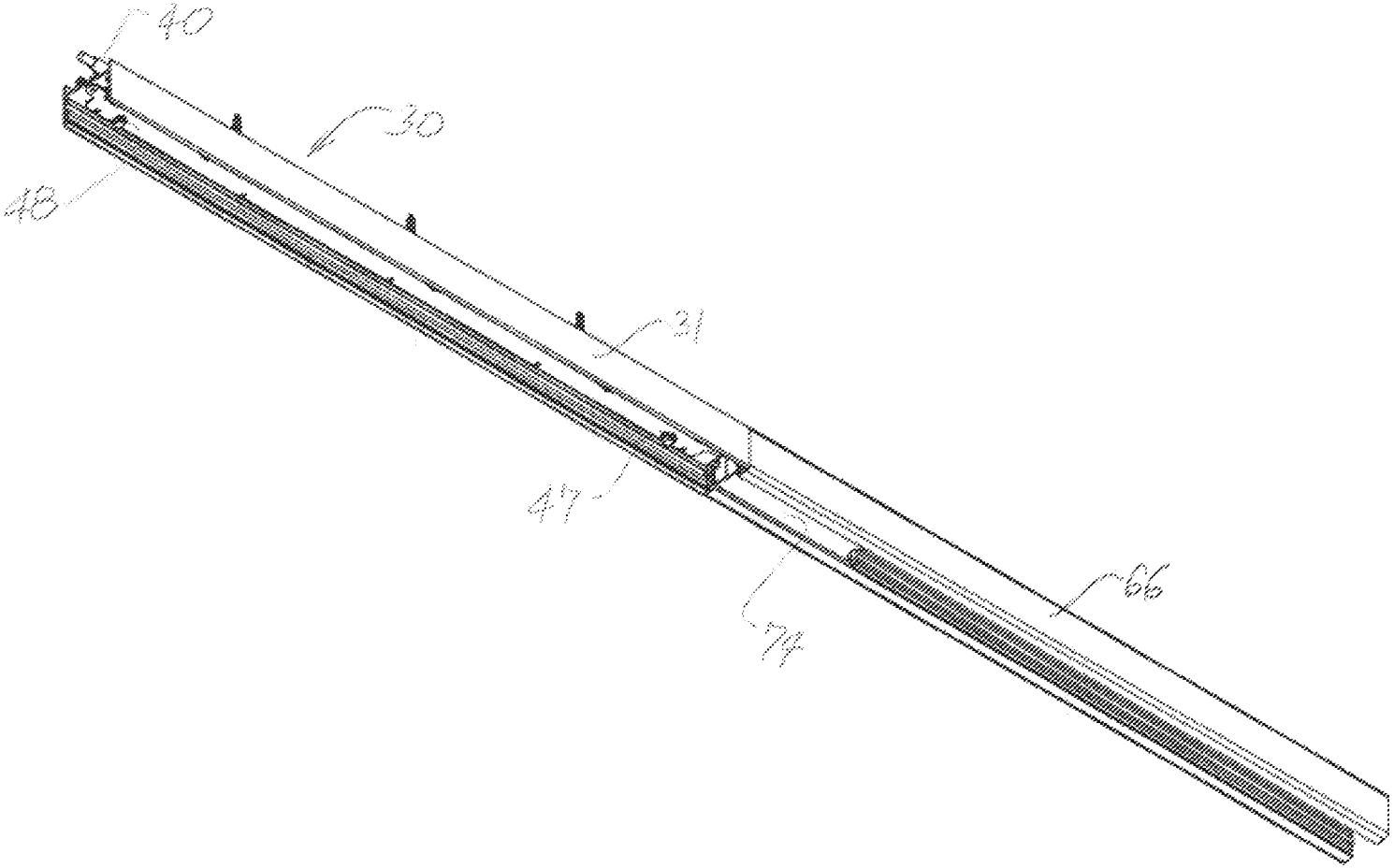
FIG. 2 is an orthographic view from below of the new LED luminaire connected to a standard track section.
Figures 11, 12:
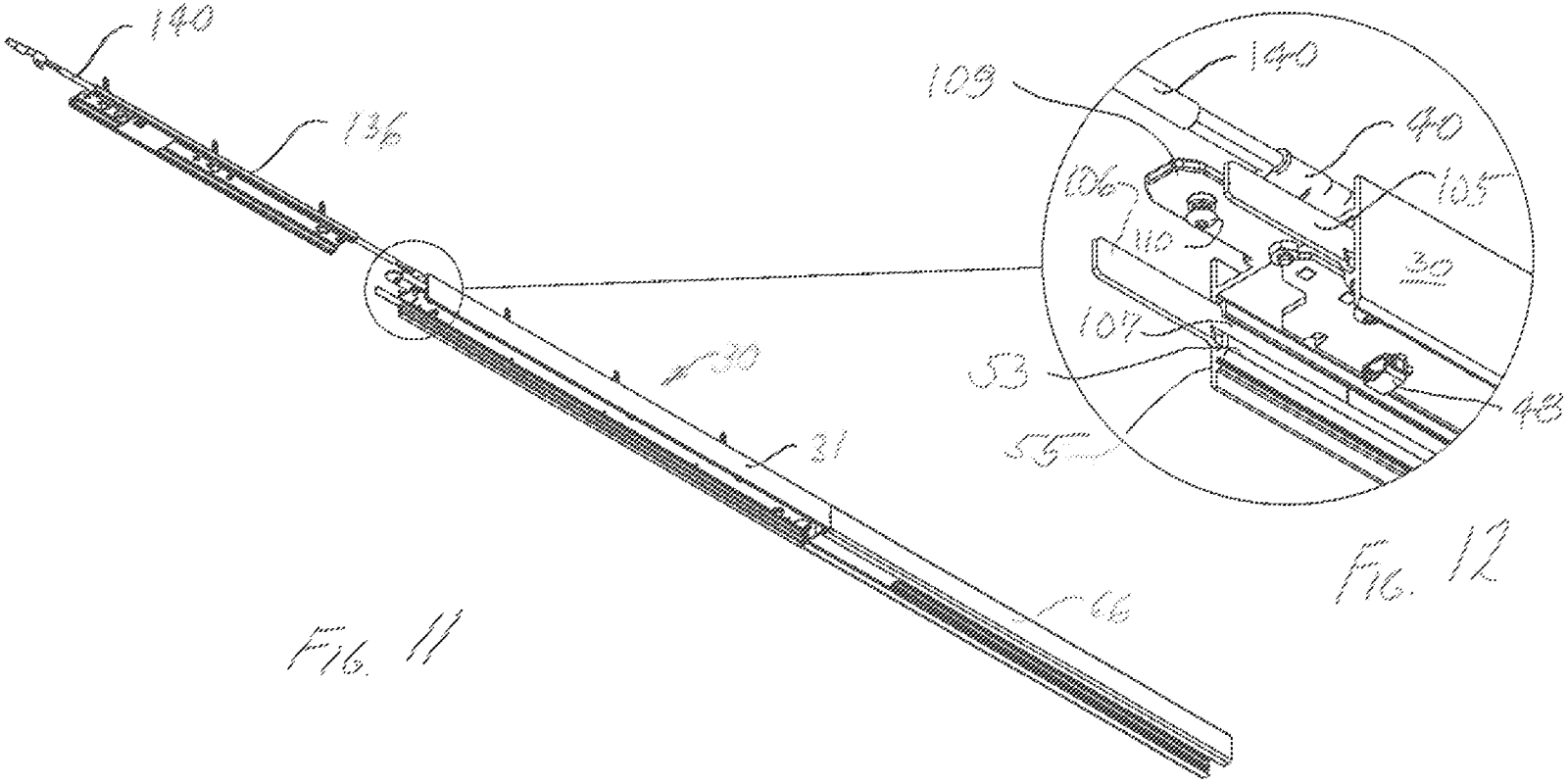
FIG. 11 is an orthographic view from below illustrating the manner in which the new LED luminaires can be joined in series in a typical track lighting system according to the invention.
FIG. 12 is an enlarged detailed view of the encircled portion of FIG. 11.

After an initial luminaire 30 has been mounted and connected, as shown in FIG. 2, a further connection can be made, either to a standard track section 66 or to another luminaire. Connection to a standard track section 66 is done in substantially the same manner as described above, using a joiner 74 to provide the desired physical and electrical attachments. In the present illustration, a second luminaire 130 is joined directly with the first luminaire 30. It is understood that the construction of the second luminaire 130 is the same as that of the first luminaire 30 and will not be repeated herein. An initial step in the installation is the mounting of a spine member 136, properly aligned with and spaced from the first spine member 36 (FIG. 11). Attachment of the main body 131 to the spine is done in the same manner as previously described. The pass through harness 40 of the first luminaire is connected, preferably by suitable plug connectors, to a similar pass through harness 140 of the second luminaire. If data signals are employed, the downstream receptacle 48 first luminaire is connected via a plug-in wire (not shown) to an upstream receptacle on the pc board of the second luminaire 130.

Figure 14:
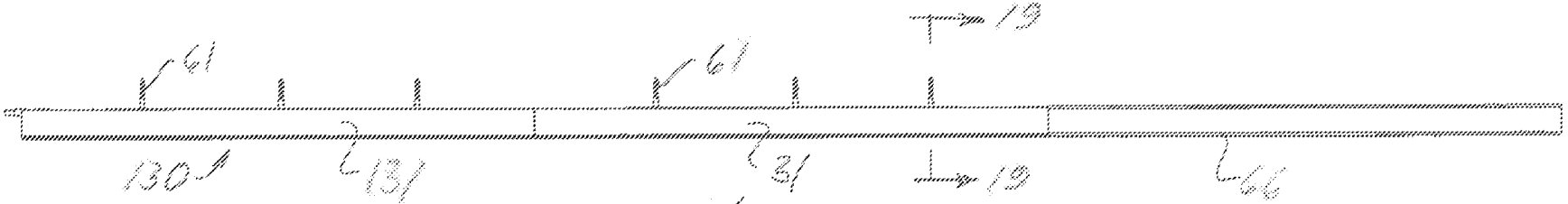
FIGS. 14 and 15 are a side elevation and bottom plan view, respectively, of the assembly of FIG. 13.
Figure 15:
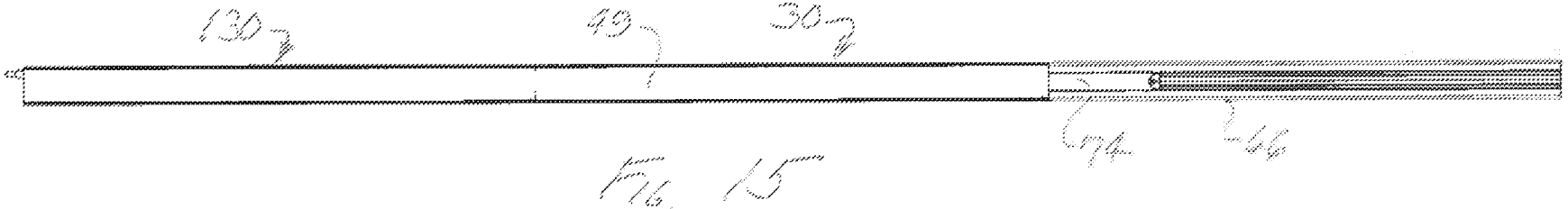

Physical connection and alignment of the first and second luminaires 30, 130 is provided in part by alignment strips 105, 106 (FIG. 12), which are inserted into slots 107 formed in the side walls 32 of the extruded main body 31. Similar slots are provided in the side walls of the second main body 131 such that, when the two main bodies 31, 131 are joined end to end (FIGS. 13-15), the two luminaires are aligned vertically and also laterally by the alignment strips. The alignment strips 105,106 may be provided with crimps 108 for positioning and retention in the slots 107. An upper alignment tongue 109 (FIG. 12) is provided to secure the luminaires 30, 130 tightly in end to end relation. The upper alignment tongue is received in the slots formed by the inverted L-shaped flanges 93, 94 and the ribs 95 (FIGS. 18, 19) and is secured therein by means of screws 110.

The procedures described above can be employed for connecting any number of the luminaires to other like luminaires and/or to standard track sections, in virtually any configuration. Luminaires can be installed throughout the track system having an appearance wholly consistent with the appearance of the standard track sections and thus both appearing and functioning as part of the track system. Both power and data are transmitted through the luminaires The embodiment of FIG. 20 is functionally similar to the previously described embodiment of FIGS. 1-19, with a principal exception that AC power, as well as data, is transmitted within the LED luminaires by copper traces on the pc board. The luminaire 230 comprises an extruded main body 231 having spaced side walls 232 connected by a horizontal web 233. A printed circuit board 237 is secured to the horizontal web by suitable screws 239 along both sides. The printed circuit board preferably is of the same type as the board 37 of the previously described embodiment, namely a high voltage AC-LED Module as made available commercially by Lynk Labs of Elgin, Ill. under its registered trademark "SnapBrite". A plurality of LED elements 238 are mounted on the pc board 237, preferably spaced about one-half inch apart along the full length of the board.

As shown in FIG. 20, the pc board 237 is provided with three copper traces 240 extending longitudinally on the board, for supplying data. As in the case of the first described embodiment, plug-in receptacles (not shown) may be provided for plug-in connections to the copper traces 240. The embodiment of FIG. 20 also includes a pair of heavier copper traces 241 extending longitudinally on the pc board for the transmission of AC power. The heavier traces 241 may have a width of about 0.05 inch, with sufficient thickness to carry a 20 amp load. Preferably the traces 241 are separated by a space of about 0.05 inch. As with the data conductors 240, the power conductors may be connected at opposite ends of the pc board 237 with suitable plug-in receptacles for connection to adjacent track sections and/or luminaires. Connections from the power traces 241 to the LED elements 238 is managed via circuitry on the PC board.

The luminaire of FIG. 20 typically will be provided with a translucent bottom cover (not shown) retained in the opposed flanges 242 at the bottom of side walls 232.

The LED track lighting element of the invention is uniquely advantageous in that it functions both as a linear LED luminaire and as an integral part of the track system in which it is incorporated. The luminaire may be provided in any standard lengths typical for the track lighting system (e.g., 2 ft, 4 ft, 8 ft), and may also be fabricated to any desired intermediate length and inserted into an existing system by removing all or part of an existing track section and replacing the removed section, or part thereof, with a luminaire according to the invention. The luminaire may be in installed as an intermediate part of a branch of a track system or as the end of a branch. As an intermediate part, the luminaire functions both as a luminaire and additionally as a conventional track section, to continue the flow of the electrical power and control data from one track section to another.

It should be understood that the invention is disclosed by way of representative but non-limiting embodiments. Accordingly, reference should be made to the following appended claims in determining the full scope of the invention.

What is claimed is:

1. A track lighting system which comprises, at least one elongated track element defining a plurality of internal insulated linear channels for the reception of power-carrying electrical conductors and optional additional conductors for carrying data signals, said track element having spaced apart side walls defining a longitudinally extending channel which is open at the bottom for the reception of electrical fixtures, said electrical conductors being exposed to said channel, whereby electrical fixtures, when received in said channel, may be connected to selected ones of said conductors at variable positions along the length of said track element, at least one elongated luminaire joined at one end thereof with one end of said track element and forming a continuation of said track element, said luminaire having a main body including spaced apart side walls joined by a transverse web, a printed circuit board secured in said luminaire and provided on a downwardly facing side thereof with a plurality of longitudinally spaced apart LED elements electrically connected by printed circuitry on said board, a joiner connected to said one end of said track element and to said one end of said luminaire and securing said luminaire to said track element, in substantial alignment therewith, said joiner having first contact means engaging selected ones of said exposed electrical conductors of said track element, including said power-carrying conductors, first and second power conductors extending longitudinally through said luminaire, said first and second power conductors being connected by said joiner to said power-carrying conductors of said track element, and circuit means connecting said first and second power conductors to said LED elements.

2. A track lighting system according to claim 1, wherein said first and second power conductors comprise elements of a pass-through harness extending from one end to the other of said luminaire, said pass-through harness including a pig tail having conductors connected respectively to said first and second power conductors and connected to said LED elements via printed circuitry on said circuit board.

3. A track lighting system according to claim 2, wherein said system includes a plurality of luminaires connected end to end in series, each of said luminaires having a pass-through harness extending therethrough and connected with an adjacent luminaire or an adjacent track section.

4. A track lighting system according to claim 1, wherein said luminaire has side walls corresponding in width to a width of the track element side walls, an optical bottom structure in mounted to said luminaire for the transmission of light from said LED elements said bottom structure being positioned at a level to correspond generally with bottoms of said track element side walls, whereby said luminaire has an appearance similar to said track sections.

5. A track lighting system according to claim 2, wherein, said luminaire further includes a spine member configured for attachment to a ceiling structure and for engagement with the main body of the luminaire, said spine member including channels at opposite sides thereof, one of said channels receiving said power conductors.

6. A track lighting system according to claim 5, wherein, said transverse web is positioned below upper edges of the luminaire side walls to form an upwardly opening channel for the reception of said spine member.

7. A track lighting system according to claim 1, wherein, said LED elements are positioned on said printed circuit board to extend along a center line of said luminaire main body, said main body, at a bottom thereof, is closed by a light-transmitting optic, said optic including a light transmitting bottom wall and light-reflecting side walls extending upward and inward from opposite sides of said bottom wall.

8. A track lighting system according to claim 7, wherein, said light-reflecting side walls extend upward substantially into contact with said printed circuit board, with upper ends of said side walls being positioned adjacent to and on opposite sides of said LED elements.

9. A track lighting system according to claim 7, wherein, said optic includes resilient flanges extending upward from opposite side edges of said bottom wall and resiliently engageable with retaining elements on insides of the side walls of said luminaire main body.

10. A track lighting system according to claim 1, wherein, said luminaire main body comprises spaced apart side walls connected by a horizontal web, said horizontal web being positioned below upper edges of said side walls to form an upwardly opening channel, an elongated spine member of a width to be received in said upwardly opening channel, said spine member having means for being secured to a ceiling, and said main body having means for being secured to said spine member.

11. A track lighting system according to claim 10, wherein, said spine member is of shorter length than said main body and is formed with a channel along at least one side edge thereof for the reception of wiring.

12. A track lighting system according to claim 11, wherein, said spine member has downwardly directed side walls forming a downwardly opening channel received within the upwardly opening channel of said main body, said wiring includes a pass through harness containing at least said first and second power conductors, and said channel has at least one lateral opening for therein to enable a looping of said harness in a space formed by said channels.

13. A track lighting system according to claim 1, wherein, said joiner has a body portion received in said at least one elongated track element, a tongue element extends longitudinally from said joiner body portion and is engaged with said luminaire main body for securing and aligning said main body with said track element, said joiner having spring actuated contacts providing electrical contact with conductors carried by said track element, said pass through harness being connected to said spring actuated contacts.

14. A track lighting system according to claim 13, wherein, said joiner has a body of insulating material and includes flanges received in said insulated linear channels in said track element to restrict stray light from said luminaire from entering the open bottom channel of said track element.

15. A track lighting system according to claim 1, wherein said first and second power conductors comprise a pair of copper traces printed on said circuit board and extending longitudinally substantially from one end to the other thereof, and connected on said circuit board to said LED elements.

16. A track lighting system according to claim 15, wherein additional copper traces are printed on said circuit board, extending longitudinally substantially from one end to the other thereof for transmitting data.

* * * * *